United States Patent [19]

Rich et al.

[11] Patent Number: 4,710,753

[45] Date of Patent: Dec. 1, 1987

[54] SECURITY SYSTEM TRANSMISSION LINE

[75] Inventors: Brian G. Rich, Nepean; John W. Patchell, Carleton Place; R. Keith Harman, Kanata, all of Canada

[73] Assignee: Senstar Security Systems Corporation, Ontario, Canada

[21] Appl. No.: 699,742

[22] Filed: Feb. 8, 1985

[30] Foreign Application Priority Data

Mar. 22, 1984 [CA] Canada ..... 450243

[51] Int. Cl.[4] ..... G08B 13/26

[52] U.S. Cl. ..... 340/561; 342/27

[58] Field of Search ..... 340/561, 552, 554, 564; 343/5 PD; 174/35 R, 37; 342/27

[56] References Cited

U.S. PATENT DOCUMENTS

| | | | |
|---|---|---|---|
| 3,801,976 | 4/1974 | Ross et al. | 340/561 |
| 3,896,425 | 7/1975 | Erichsen | 340/564 X |
| 4,091,367 | 5/1978 | Harman | 333/237 |
| 4,375,009 | 2/1983 | Fearnside et al. | 174/35 R |

OTHER PUBLICATIONS

"Guidar: An Intrusion Detection System for Perimeter Protection", by R. K. Harman 1976 Carnahan Conferences on Crime Counter-Measures, Lexington, KY, pp. 155–159.

*Primary Examiner*—James L. Rowland
*Assistant Examiner*—Jeffery A. Hofsass
*Attorney, Agent, or Firm*—Antonelli, Terry & Wands

[57] ABSTRACT

The invention relates to a leaky cable intrusion detection system comprising a pair of spaced, parallel, buried, leaky coaxical cables. A radio frequency signal is applied to one of the cables, whereby an electromagnetic field outside said one cable is established, and a radio frequency signal from the field penetrates and is received from the other of the cables whereby disturbances in said field can be detected. The cables are spaced apart a distance such that they are intermediately coupled, being coupled to a greater degree than loosely coupled and to a laser degree than tightly coupled. In the preferred embodiment a longitudinal shield is spaced from and is below the cables. By varying the spacing between the cables and the shield, variations in field shape and sensitivity of the system can be substantially reduced.

36 Claims, 7 Drawing Figures

SECURITY SYSTEM TRANSMISSION LINE

This invention relates to security systems, and in particular to a leaky coaxial cable transmission line structure for use in such system.

Leaky coaxial cable intrusion detection systems are generally comprised of a pair of parallel leaky coaxial cables buried in the ground to define a security line. A radio-frequency signal is applied to a first one of the cables, either in pulse or continuous wave (CW) form. As a result of radio-frequency field penetration of the leaky cable, an electromagnetic field is set up along the first cable, appears as a surface wave above ground, and penetrates the leaky shield of the second cable, a receiver being connected to the second cable. An intruder into the field which has been set up modifies the field and the resulting receiving signal from the second coaxial cable can be analyzed to determine the presence of the intruder, or in some systems the location of the intrusion. Such systems are well known; one such system was described in U.S. Pat. No. 4,091,367 issued May 23rd, 1978, invented by Robert K. Harman; the general theory of such systems was described in a paper by Robert K. Harman and John E. Siedlarz given to the 1982 Carnahan Conference on Security Technology, at the University of Kentucky, May 12–14, 1982.

In the above-described patent and in other similar leaky cable intrusion detection systems, it was found necessary to space the cables to obtain loose coupling; the cables were defined as being spaced apart a minimum of two orders of magnitude greater than the outside diameters of the cables apart, typically about four feet apart. The cables were buried approximately one foot into the earth's surface which resulted in a detection sensitive zone approximately four feet high and twelve feet wide, given typical transmitter power, R.F. frequency, cable leakage and receiver sensitivity. This cable spacing was chosen to ensure that birds or other small animals could be discriminated against in favour of objects the size of human beings, vehicles, etc.

It has been found that in some installations, the total sensitivity, or the sensitivity inexplicitly substantially increased or decreased over some stretches of the security line. Persons or vehicles relatively distant from the detection line were detected as intruders, as well as small animals closer to the security line. The false alarm rate increased to an unacceptable extent.

We have found that the variations in sensitivity can be reduced, and indeed controlled, by the invention described herein.

One structure for reducing the sensitivity, we have found, is to place the parallel cables close together, i.e., that they should be intermediately coupled such that they interact, but are not loosely coupled as defined in the aforenoted U.S. Pat. No. 4,091,367, or tightly coupled as in U.S. Pat. No. 3,801,976, or references referred to therein. For a system in which the radio frequency signal is approximately forty MHz, the effective intermediate coupling separation has been found to be between two and twelve inches.

We have found that the greatest effect which facilitates direct control of variations in the field along different portions of the security line as the cables pass through different soil material characteristics, is to place a shield or ground plane below or below and beside the cables. The sensitivity of the security zone can be changed merely by raising or lowering the cables toward or away from the shield.

We have also found that burying the cables at varying distances from the surface of the earth can change the overall sensitivity; the closer the cables are to the surface of the earth, the larger the field.

The cables can alternatively or additionally be buried in a predetermined dielectric medium, such as rubber, soilcrete, oil saturated earth, etc. in order to provide a predetermined field characteristic; the dielectric can be enclosed by a U-shaped shield. A unitary structure can be formed by shield, dielectric and cables and the entire enlongated structure can be either buried in the earth or fastened to a wall.

A water and chemical impervious layer such as a rubber sheet or membrane can be laid over the surface of the dielectric above, and within the region of the cables, having at least the width of the shield, in order to protect the earth or other dielectric material between the cables and between and above the cables and the shield. The sheet or membrane could of course be camouflaged.

It has been found that the above structure facilitates control of the radio-frequency field shape and cross-sectional area, thus eliminating in a controllable way the above-described problem of excess or reduced sensitivity over the entire, or over portions of the security line.

The term "buried" in this specification should be construed to be not restricted to burial in the ground. The term is to be inclusive of burial in any suitable dielectric medium, such as earth, sand, rubber, concrete, mixtures of cement and earth of various kinds, oil saturated earth, etc.

A better understanding of the invention will be obtained by consideration of the detailed description below, with reference to the following drawings, in which.

Figure 1:
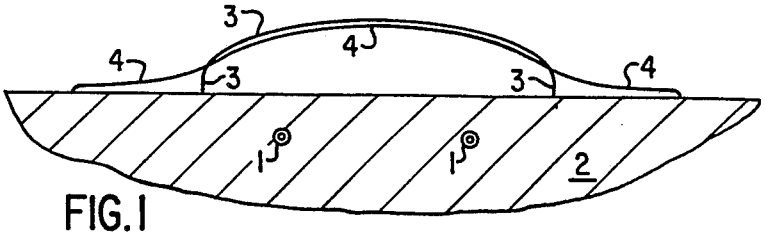
FIG. 1 is a cross-section of the earth showing a pair of buried leaky coaxial cables of an intrusion detection system.

FIG. 1 shows the cross-section of a pair of leaky coaxial cables 1 for use in a leaky cable intrusion detection system of either pulsed or CW type which are buried in the earth 2 along a security line to be protected. As is known in the prior art, one of the cables is connected to a CW or pulse transmitter and the other cable is connected to a detecting receiver. In such systems, a curve 3 of constant surface wave field intensity having a representative shape as shown is established above the surface of the earth. A mass of a given size entering the field disturbs the field and is detected in the detected receiver as described in the prior art, e.g. as in the aforenoted U.S. Pat. No. 4,091,367.

However it has been found that in some installations, or in some regions along the cables of a given installation, the field shape changes, for instance increasing enormously close to the earth, resulting in expansion of the previous field intensity, i.e. to curve 4. The cross-sectional area of the curve can be proportionally of the size shown, or larger or smaller, but in general it has been found that such increased field width results in a highly unreliable detection system. As was noted earlier, such greatly increased field width has been found to cause false alarms due to detection of small animals, distant persons, vehicles, etc. Typically such prior art systems installed with the cables 1 loosely coupled, and separated by a distance which is 2 orders of magnitude multiple of the cable diameter, typically four feet apart and one foot below the earth's surface.

Figure 2:
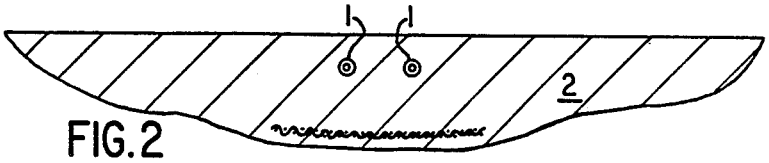
FIG. 2 is a cross-section of the earth showing the cables according to a preferred embodiment of the invention.

However it has now been found that the increased sensitivity can be reduced by separating the cables a distance such that they interact, but are not directly coupled, as shown in FIG. 2. In order to distinguish the separation distance, they will be referred to herein as intermediately coupled as described earlier. In a typical system, in which the radio frequency signal is 40 megahertz and the leaky coaxial cables are approximately ⅜ inch diameter the separation between the cables should be between 2 and 12 inches. This distinguishes from prior art U.S. Pat. No. 4,091,367 in which the separation was specified as being no less than 37.5 inches (greater than 3 feet) for this diameter cable. With a separation of smaller than approximately 2 inches, the cables are closely coupled as described in U.S. Pat. No. 3,801,976, which should be avoided for the present invention. A disitance significantly greater than 12 inches results in the external electromagnetic field tending to revert back to the form of reference numeral 3 which has been found in some instances to be the approximate shape of the field for the system described in U.S. Pat. No. 4,091,367.

While the above-described embodiment has been found to improve the detection zone shape to some extent, it has been found that an even greater effect is obtained by placing a shield 5 below the cables. Note that use of narrow cable spacings makes the installation of such a shield much more feasible. It has further been found that as the bottom of the shield is brought closer to the cables, the outlying width of the field close to the ground decreases. Thus the field size and shape can be controlled merely by lowering or raising the cables over sections of the security line which shows evidence of increased field width or decreased sensitivity respectively, whereby variations in the sensitivity along the line can be reduced.

Figure 3A:
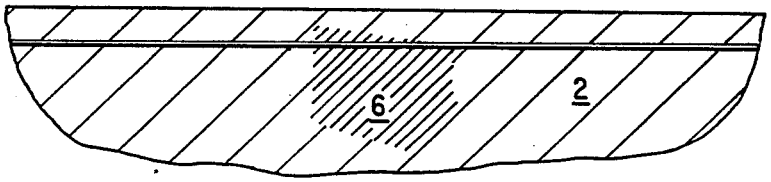
FIG. 3A is a longitudinal cross-section of the earth having varying conductivity.

FIG. 3A depicts the cables 1 in a longitudinal cross-section of the earth 2. It appears that a region 6 of the earth is present over which an increase field width is evidenced as shown by the system detection sensitivity graph in Figure B.

Figure 3B:
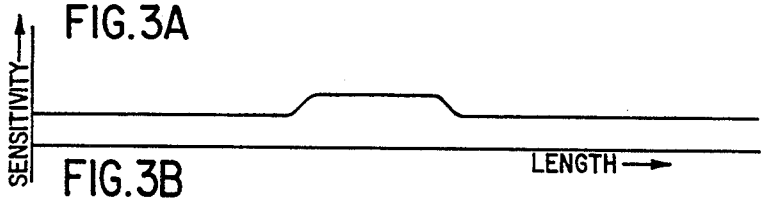
FIG. 3B is a representative sensitivity graph of a prior art system over the cable length shown in FIG. 3A.
Figure 3C:
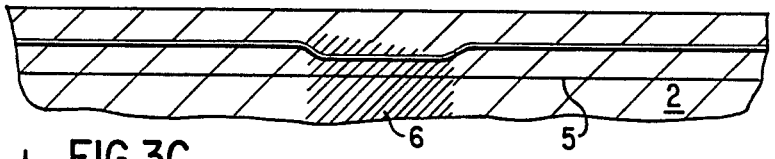
FIG. 3C is a longitudinal cross-section of the earth, showing the present invention.

According to the present invention, as shown in FIG. 3C, a shield 5 as described above is located below cables 1, but in region 6, the cable is lowered toward the shield 1.

Figure 3D:
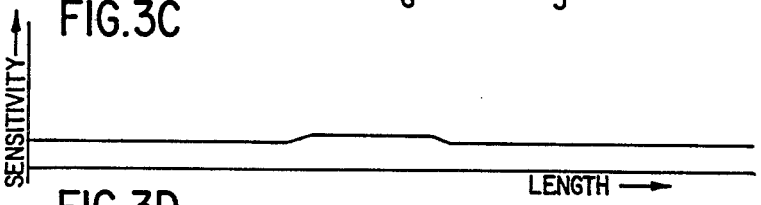
FIG. 3D is a representative sensitivity graph showing reduced field variation using the present invention.

This results in a sensitivity curve as represented in FIG. 3D, in which the sensitivity of the system over the length of the security line evidences much fewer variations.

It is a relatively easy matter to vary the distance of the cables relative to the shield, in order to adjust the field width as well as the detection sensitivity of the system over the length of the security line. Clearly the cables can be raised or lowered as required, to even out variations in the detection sensitivity.

The above has been found to have a profound effect on the utility of such systems, since for the first time systems can be installed at places where until now unexplained and undesirable variations in sensitivity, have rendered the system virtually useless because of an unacceptable false alarm rate and/or because of regions of substantially reduced detection.

It should be noted that the sensitivity graphs shown in FIGS. 3B and 3D are representative only for illustrating the advantages of the invention, and small local or very broad variations (which can be reduced by the use of the present invention) are not shown, for the purpose of clarity.

In a typical system operating with a radio-frequency continuous wave signal (but can be either a pulsed type system or a continuous wave system), the leaky coaxial cables were spaced horizontally six inches apart, and were buried nine inches down from the surface of the earth. A U-shaped shield enclosed the cables, the shield having a bottom two feet wide and sides two feet high. The open part of the "U" faced upwardly.

The shield, which as was noted earlier forms a ground plane, can be formed of metal mesh, and made of a non-corrosive material, or can be covered with a protective material such as platic, in a well known manner. It is preferred that the shield should be flat, dish-shaped in cross-section, or other shape below the cables, and need not be U-shaped.

It should be noted that while the cables have been shown in the figures having their axes lying in a plane which is horizontal, or parallel to the surfaces of the earth, the plane could be vertical or at an angle somewhere between the horizontal and vertical (for example one cable can be above the other).

As an example, to install the system, a trench cutter is used to dig an elongated trench, typically two feet wide and two feet deep along a security line. A mesh shield or ground plane is then installed along the floor of the trench. The earth (or sand, or other material excavated to form the trench) is placed back in the trench above the shield to a depth of twelve to fifteen inches, leaving a trench of nine to twleve inches. The pair of coaxial cables are then installed, running along the trench parallel to each other, approximately six inches apart. Once this has been completed the remainder of the trench is filled in with the remainder of the excavated materials.

The cables are then connected to the transmitter and receiver, power is applied and the resulting electromagnetic field is measured at a predetermined distance (e.g. six feet) from the trench, along the entire trench, and the field intensity is recorded. The regions of excessive or reduced sensitivity are determined from the measurements, and in those regions the trench is re-excavated, the cables lowered toward or raised from the cables, and the excavated material placed back in the trench.

The above process is repeated as necessary in order to minimize variations in the system sensitivity along the security line.

It appears that the material contained within the shield and between the cables forms a dielectric, and with the shield and cables form a general open guiding structure. Thus for some applications the dielectric within the shield 5 can be substituted with another suitable material, such as oil soaked or saturated earth.

A cement-earth mixture could be used within the shield 5, which would harden when wet and repel rain and/or chemicals. Either has the advantage that contaminants such as water, etc. would be repelled and would not seep into the dielectric structure within the shield 5, which would otherwise undesirably change its conductivity and thus its dielectric constant.

Another technique for ensuring that the dielectric within the shield 5 is protected from chemical or other sensitivity-changing contaminants, is to place a repellent sheet or membrane such as rubber on the surface of the earth or otherwise over the surface of the dielectric, at least extending the width and length to be protected of the shield 5.

It should be noted that since it appears that the leaky cable pair, shield and dielectric material contained within the shield forms an open guiding structure, it can be located as a unit outside of the earth. Thus for example where the dielectric contained within the shield is concrete or some other suitable material, the structure can be formed into or on a wall.

Figure 4:
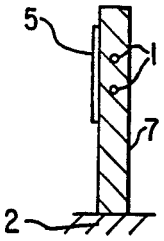
FIG. 4 is a cross-section of a second embodiment of the invention in a wall.

In the embodiment shown in FIG. 4 the shield 5 can be formed of a mesh or assembly of elongated wires, the dielectric material 9 can be the concrete material of the wall or if suitably built, earth or sand, and the cables can be embedded in the wall.

Since the conductivity and dielectric constant of the dielectric can be controlled this also affords a means of controlling the field intensity, and thus the sensitivity of the system.

It should be noted that since the system utilizes radio-frequencies (e.g. 10–400 MHz), the minimum and maximum spacing between the cables and the spacing of the cables from the shield will vary with respect to different frequencies to ensure intermediate coupling. While the preferred distances were described above with respect to a radio-frequency signal of 40 MHz or the described cable and observed dry earth dielectric if a higher frequency is used, the minimum and maximum separation distances may decrease, but this depends on factors such as cable diameter and soil dielectric. The distance for intermediate coupling decreases as the cable diameter decreases, or as the dielectric constant of the dielectric increases.

Thus an invention has been described which substantially increases the utility of leaky cable intrusion detection system in regions where previous apparent variations in conductivity and dielectric of the soil caused substantial variations in field shape and thus system sensitivity, resulting in a high false alarm rate. The present system affords a structure and method for adjusting the sensitivity of the system whereby such variations in sensitivity are substantially reduced.

A person understanding this invention may now conceive of other embodiments based on the principles described herein. All are considered to be within the sphere and scope of the invention as defined in the claims appended hereto.

We claim:

1. A leaky cable intrusion detection system comprising a pair of spaced, parallel, buried, leaky coaxical cables, means for applying a radio frequency signal to one of the cables, whereby an electromagnetic field outside said one cable is established, means for receiving a radio frequency signal from the field from the other of the cables whereby disturbances in said field can be detected, the cables being spaced apart a distance such that they are intermediately coupled, being coupled to a greater degree than loosely coupled and to a lesser degree than tightly coupled, wherein the cables are buried in a subsoil material of varying conductivity and dielectric constant, a longitudinal shield buried with the cables located along, below and spaced from the cables, the distance between the cables and the shield below the cables decreasing with decreasing conductivity and/or dielectric constant of said material, and increasing with increasing conductivity and/or dielectric constant said material, whereby variations in said electromagnetic field which may be caused by at least said varying conductivity and dielectric constant, are substantially reduced.

2. A system as defined in claim 1 in which the axes of the cables are in an approximately horizontal plane substantially parallel to the surface of the earth.

3. A system as defined in claim 2, in which the cables are spaced between approximately two and twelve inches apart.

4. A system as defined in claim 2 in which the longitudinal shield is formed of conductive mesh located below the cables, the shield being upwardly open.

5. A system as defined in claim 1 in which the axes of the cables are in an approximately vertical plane.

6. A system as defined in claim 5 in which the longitudinal shield is formed of conductive mesh located below the cables, the shield being upwardly open.

7. A system as defined in claim 1, in which the longitudinal shield is formed with a "U" cross-section, with an open side of the "U" facing upwardly, the cables being contained centrally longitudinally within the shield, the shield being filled with a cable burial dielectric medium.

8. A system as defined in claim 1, in which the cables are located centrally over the shield and are spaced from the shield a distance at least as great as one-half the distance between the cables, a dielectric medium surrounding the cables at least above the shield.

9. A system as defined in claim 8 in which the dielectric medium has a predetermined dielectric constant, the medium being a predetermined cross-sectional area and shape and such that a guiding dielectric structure for said electromagnetic field is formed.

10. A system as defined in claim 1 in which the subsoil is comprised of oil soaked earth.

11. A system as defined in claim 1 in which the subsoil is comprised of a cement-soil mixture.

12. A system as defined in claim 1 further including a longitudinal contaminant protective sheet overlying the burial medium having width at least approximately four times the spacing of the cables.

13. A leaky cable intrusion detection system comprising a pair of spaced, parallel, buried, leaky coaxical cables, means for applying a radio frequency signal to one of the cables, whereby an electromagnetic field outside said one cable is established, means for receiving a radio frequency signal from the field from the other of the cables whereby disturbances in said field can be detected, the cables being spaced apart a distance such that they are intermediately coupled, being coupled to a greater degree than loosely coupled and to a lesser degree than tightly coupled, wherein the cables are buried in a subsoil material of varying conductivity or dielectric constant and are spaced between approximately two and twelve inches apart, a longitudinal shield approximately two feet wide located along and below the cables, the distance between the cables and the shield decreasing with decreasing conductivity and- /or dielectric constant of said material, and increasing with increasing conductivity and/or dielectric constant said material, whereby variations in said electromagnetic field which may be caused by at least said varying conductivity, and/or dielectric constant are substantially reduced.

14. A method of making a leaky cable intrusion detection system comprising:

(a) digging a longitudinal trench of about two feet deep in the ground along a protection line, (b) laying a longitudinal shield along at least the bottom of the trench, (c) burying the shield by partly filling the trench approximately twelve to fifteen inches.

(d) laying a pair of leaky coaxial cables parallel to each other within the remaining trench depth, spaced between two and twelve inches, (e) filling the trench, (f) applying a radio frequency signal to one of the cables, to set up an electromagnetic field above ground, (g) checking the intensity of the electromagnetic field along the protection line and identifying regions of excessively high and/or low intensity relative to a predetermined intensity, (h) excavating the trench in the regions of excessively high and/or low intensity, (i) lowering the cable toward the shield in the regions of excessively high intensity and raising the cables away from the shield in regions of excessively low intensity, and reburying the cables in said regions, (j) repeating steps g, h and i as necessary, whereby variations in field intensity are reduced.

15. A method as defined in claim 14 in which the shield is approximately the same width as the trench.

16. A method as defined in claim 15 in which the radio frequency signal is either pulsed or continuous wave, and at a frequency between 10 and 400 MHz.

17. A method as defined in claim 14 in which the radio frequency signal is either pulsed or continuous wave, and at a frequency between 10 and 400 MHz.

18. A leaky cable intrusion detector system, comprising a pair of spaced, parallel cables buried within the ground, means for applying a radio frequency signal to an end of one of the cables, whereby an electromagnetic field outside said one cable can be established, means for receiving a signal derived from the field from the other of the cables whereby the existence of an intruding mass into the field which affects the field can be detected, a shield buried longitudinally below the cables a predetermined distance from the surface of the ground, the burial depth of the cables varying whereby the distance between the cables and the shield decreases with decreasing conductivity and/or dielectric constant of the ground, and increases with increasing conductivity and/or dielectric constant of the ground whereby undesirable variations in the field strength are reduced to a substantial extent.

19. A system as defined in claim 18, in which the distance between the cables is between two and twelve inches.

20. A system as defined in claim 19 in which the width of the shield is large relative to the distance between the cables.

21. A system as defined in claim 19 in which the width of the shield is approximately four times the distance between the cables.

22. A system as defined in claim 19 in which the cables are buried approximately nine inches below the surface of the ground centrally of the shield, the width of the shield is about two feet, buried about two feet below said surface in ground of nominal conductivity.

23. A system as defined in claim 19 in which the shield is U-shaped and has its open side directed upwardly, and contains the pair of cables, the cables being buried approximately nine inches below the surface of the ground, the width of the shield being about two feet, and buried about two feet below said surface, the frequency of the radio frequency signal being between approximately 10 and 400 MHz.

24. A system as defined in claim 19 in which the cables are buried approximately nine inches below the surface of the ground centrally of the sheet, the width of the shield is about two feet, and is buried about two feet below said surface, the radio frequency signal being either of continuous wave or pulsed form, and has a frequency of approximately 40 MHz.

25. A system as defined in claim 18, in which the distance between the cables is nominally six inches.

26. A system as defined in claim 25 in which the width of the shield is large relative to the distance between the cables.

27. A system as defined in claim 25 in which the width of the shield is approximately four times the distance between the cables.

28. A system as defined in claim 25 in which the cables are buried approximately nine inches below the surface of the ground centrally of the shield, the width of the shield is about two feet, buried about two feet below said surface in ground of nominal conductivity.

29. A system as defined in claim 25 in which the shield is U-shaped and has its open side directed upwardly, and contains the pair of cables, the cables being buried approximately nine inches below the surface of the ground, the width of the shield being about two feet, and buried about two feet below said surface, the frequency of the radio frequency signal being between approximately 10 and 400 MHz.

30. A system as defined in claim 25 in which the cables are buried approximately nine inches below the surface of the ground centrally of the sheet, the width of the shield is about two feet, and is buried about two feet below said surface, the radio frequency signal being either of continuous wave or pulsed form, and has a frequency of approximately 40 MHz.

31. A system as defined in claim 18, in which the width of the shield is greater than the distance between the cables.

32. A system as defined in claim 18 in which the width of the shield is approximately four times the distance between the cables.

33. A system as defined in claim 18 in which the cables are buried approximately nine inches below the surface of the ground centrally of the shield, the width of the shield is about two feet, buried about two feet below said surface in ground of nominal conductivity.

34. A system as defined in claim 18 in which the shield is U-shaped and has its open side directed upwardly, and contains the pair of cables, the cables being buried approximately nine inches below the surface of the ground, the width of the shield being about two feet, and buried about two feet below said surface, the frequency of the radio frequency signal being between approximately 10 and 400 MHz.

35. A system as defined in claim 18 in which the cables are buried approximately nine inches below the surface of the ground centrally of the sheet, the width of the shield is about two feet, and is buried about two feet below said surface, the radio frequency signal being either of continuous wave or pulsed form, and has a frequency of approximately 40 MHz.

36. A system as defined in claim 18 in which the longitudinal shield is formed of conductive mesh located below the cables, the shield being upwardly open.

* * * * *